US008651985B2

(12) United States Patent
Yamamoto

(10) Patent No.: US 8,651,985 B2
(45) Date of Patent: Feb. 18, 2014

(54) RACKET FRAME

(75) Inventor: Yosuke Yamamoto, Kobe (JP)

(73) Assignee: Dunlop Sports Co. Ltd., Kobe-Shi, Hyogo (JP)

( * ) Notice: Subject to any disclaimer, the term of this patent is extended or adjusted under 35 U.S.C. 154(b) by 0 days.

(21) Appl. No.: 13/589,408

(22) Filed: Aug. 20, 2012

(65) Prior Publication Data

US 2013/0172134 A1 Jul. 4, 2013

(30) Foreign Application Priority Data

Dec. 28, 2011 (JP) ..... 2011-289828
Jan. 12, 2012 (JP) ..... 2012-004449

(51) Int. Cl.
*A63B 49/02* (2006.01)

(52) U.S. Cl.
USPC ..... 473/537; 473/546; 473/524

(58) Field of Classification Search
USPC ..... 473/520, 521, 524, 535, 536, 537, 546
See application file for complete search history.

(56) References Cited

U.S. PATENT DOCUMENTS

| | | | | |
|---|---|---|---|---|
| 3,752,478 | A | 8/1973 | Flak | |
| 5,249,798 | A | 10/1993 | Miyamoto | |
| 5,310,179 | A * | 5/1994 | Takatsuka | 473/537 |
| 5,538,243 | A * | 7/1996 | Yamamoto et al. | 473/537 |
| 6,688,997 | B2 * | 2/2004 | Ashino et al. | 473/535 |
| 8,137,221 | B2 * | 3/2012 | Ashino | 473/535 |
| 2005/0266941 | A1 * | 12/2005 | Ashino et al. | 473/535 |
| 2013/0172134 | A1 * | 7/2013 | Yamamoto | 473/537 |

FOREIGN PATENT DOCUMENTS

| | | | |
|---|---|---|---|
| DE | 3609453 | A1 | 10/1987 |
| GB | 1423046 | A | 1/1976 |

* cited by examiner

*Primary Examiner* — Raleigh W Chiu
(74) *Attorney, Agent, or Firm* — Birch, Stewart, Kolasch & Birch, LLP

(57) ABSTRACT

A racket frame 2 includes a head 4, a shaft 8, and a pair of throats 6 extending from the head 4 to the shaft 8. A flexural rigidity $G_{15}$ of the throats 6 in a low load range (from 5 kgf to 15 kgf) is equal to or greater than 600 kgf/mm but equal to or less than 900 kgf/mm. A flexural rigidity $G_{55}$ of the throats 6 in a high load range (from 45 kgf to 55 kgf) is equal to or greater than 900 kgf/mm but equal to or less than 1200 kgf/mm. A rigidity ratio ($G_{15}/G_{55}$) of the flexural rigidity $G_{15}$ and the flexural rigidity $G_{55}$ is equal to or greater than 0.70 but equal to or less than 0.85.

8 Claims, 11 Drawing Sheets

RACKET FRAME

This application claims priority on Patent Application No. 2011-289828 filed in JAPAN on Dec. 28, 2011 and Patent Application No. 2012-4449 filed in JAPAN on Jan. 12, 2012. The entire contents of these Japanese Patent Applications are hereby incorporated by reference.

BACKGROUND OF THE INVENTION

1. Field of the Invention

The present invention relates to frames for tennis rackets and the like. Specifically, the present invention relates to the structures of racket frames.

2. Description of the Related Art

For tennis rackets, desired rebounding performance is required in order to cause a hit ball to launch at a higher speed. In light of improving the rebounding performance, high resilience is required for tennis rackets. In order to obtain high resilience, high rigidity is required for racket frames. JP-H5-15617 (U.S. Pat. No. 5,249,798) discloses that improvement of the rigidities of a racket frame in a ball-hitting face outer direction perpendicular to a ball-hitting face and in a ball-hitting face inner direction orthogonal to the ball-hitting face outer direction contributes to improvement of rebounding performance.

Meanwhile, soft hitting feel and favorable ball-holding feel at impact are required for tennis rackets. A racket frame having a high rigidity is likely to be inferior in soft hitting feel. In addition, a racket frame having a high rigidity is likely to be inferior in holding feel. In a racket frame having a relatively low rigidity, favorable holding feel is obtained.

As described above, a racket frame having a high rigidity has high rebounding performance but deteriorates its holding feel. A racket frame having a relatively low rigidity has favorable holding feel but deteriorates its rebounding performance. In other words, rebounding performance and holding feel are contradictory to each other. It is difficult to obtain a racket frame that is excellent in both of the contradictory performance.

An object of the present invention is to provide a racket frame having both desired rebounding performance and desired holding feel.

SUMMARY OF THE INVENTION

A racket frame according to the present invention includes a head, a shaft, and a pair of throats extending from the head to the shaft. In the racket frame, a flexural rigidity $G_{15}$ of the throats in a low load range (from 5 kgf to 15 kgf) is equal to or greater than 600 kgf/mm but equal to or less than 900 kgf/mm. A flexural rigidity $G_{55}$ of the throats in a high load range (from 45 kgf to 55 kgf) is equal to or greater than 900 kgf/mm but equal to or less than 1200 kgf/mm. A rigidity ratio ($G_{15}/G_{55}$) of the flexural rigidity $G_{15}$ and the flexural rigidity $G_{55}$ is equal to or greater than 0.70 but equal to or less than 0.85.

Preferably, a groove is formed in each throat so as to extend from a head side toward a shaft side. A depth direction of the groove is parallel to a ball-hitting face. The groove is formed so as to extend from a head side end of the throat to a shaft side beyond a center of the throat in a longitudinal direction thereof.

Preferably, in a cross section of each throat that is perpendicular to the longitudinal direction, a front-back width in a direction perpendicular to the ball-hitting face gradually increases from one end of the throat toward another end of the throat in a right-left width direction that is a direction parallel to the ball-hitting face. After reaching a maximum, the front-back width gradually decreases toward the other end. The front-back width is maximum at a position closer to the one end than to the other end in the right-left width direction. The groove is formed on the one end side.

Preferably, a ratio (A/B) of a depth A of the groove from the one end in the right-left width direction and a distance B, in the right-left width direction, from the one end to the position at which the front-back width is maximum is less than 1.0.

Preferably, a depth A of the groove in a cross section of the center of the throat in the longitudinal direction is equal to or greater than 2 mm but equal to or less than 6 mm.

Preferably, the groove is formed so as to extend from the head side end of the throat to a shaft side end of the throat.

Preferably, the groove is formed so as to be connected to a gut groove formed in an outer peripheral surface of the head.

Preferably, a compressive rigidity of the throats in a front-back width direction that is a direction perpendicular to a ball-hitting face is equal to or less than 2600 kgf/mm.

The racket frame according to the present invention can improve ball-holding feel without deteriorating rebounding performance.

DESCRIPTION OF THE PREFERRED EMBODIMENTS

Hereinafter, the present invention will be described in detail based on preferred embodiments with reference to the accompanying drawings.

Figure 1:
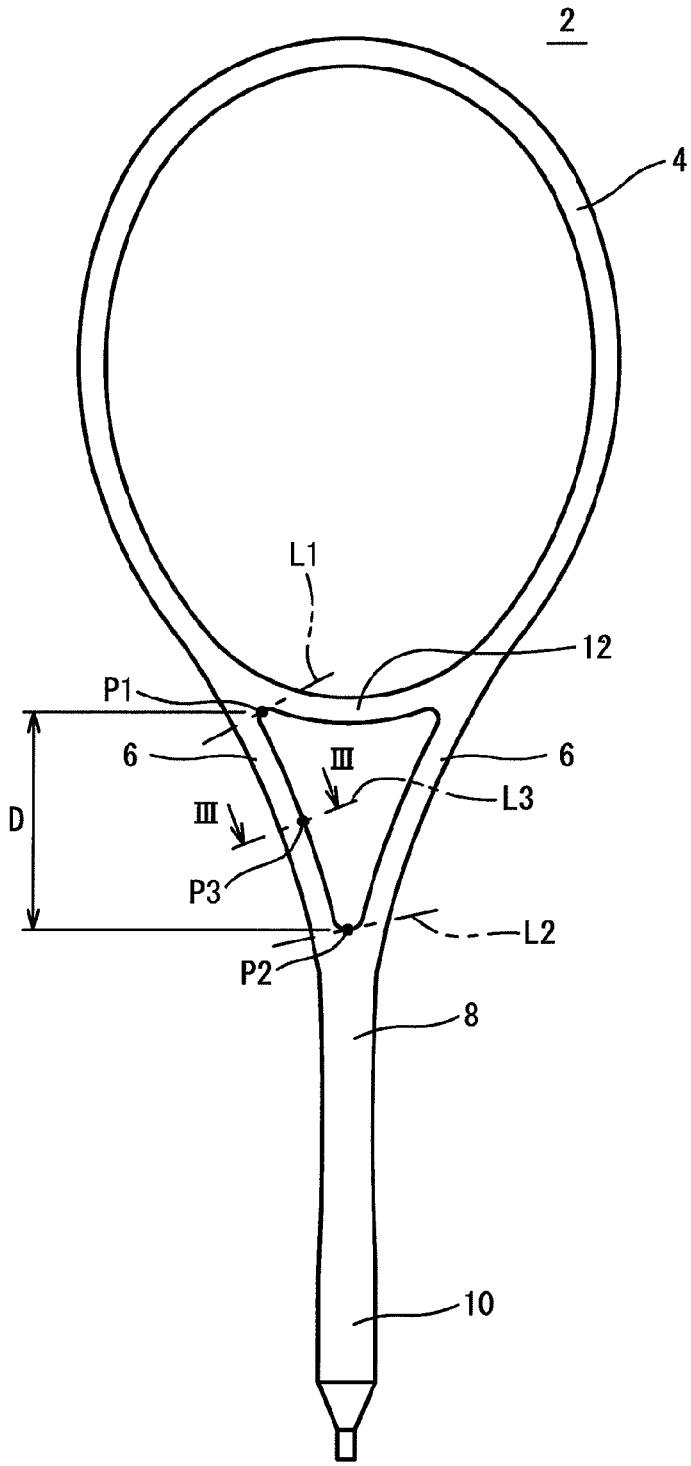
FIG. 1 is a front view of a racket frame according to one embodiment of the present invention.
Figure 2:
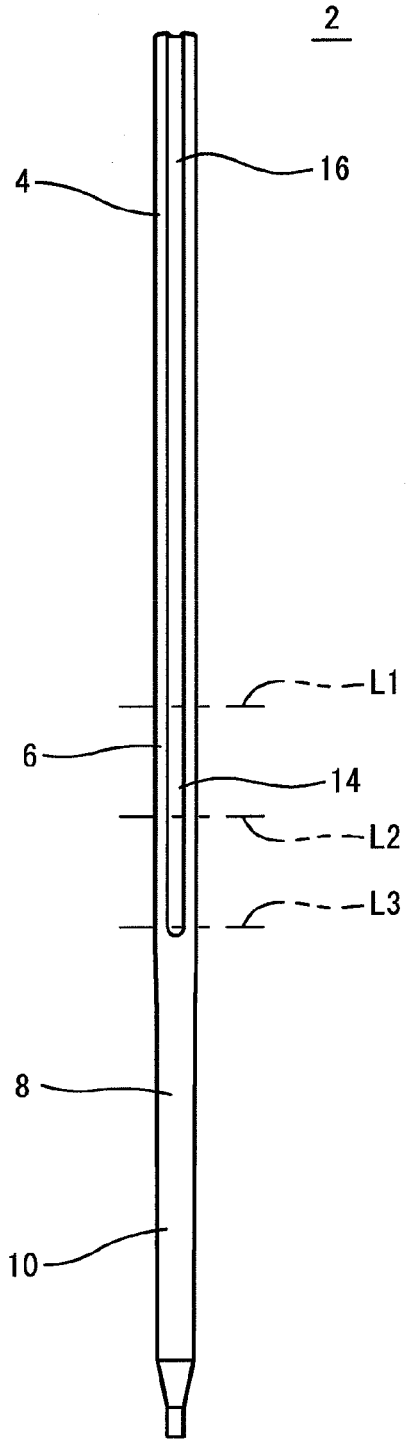
FIG. 2 is a side view of the racket frame in FIG. 1.

FIGS. 1 and 2 show a racket frame 2 according to one embodiment of the present invention. The racket frame 2 includes a head 4, a pair of throats 6, a shaft 8, and a grip 10. A grommet, a grip tape, an end cap, and the like are attached to the racket frame 2, and a gut is stretched on the racket frame 2, whereby a racket for regulation-ball tennis is obtained. In FIG. 1, the top-to-bottom direction is an axial direction of the racket frame 2.

The head 4 forms the contour of a ball-hitting face. The head 4, which forms the contour of the ball-hitting face, has a substantially elliptical front shape. One end of each throat 6 is connected to the head 4. The throats 6 extend from one end side toward the other end side in directions in which the throats 6 approach each other. Each throat 6 is connected at the vicinity of the other end thereof to the other throat 6. The throats 6 extend from the head 4 to the shaft 8. The shaft 8 extends from the location where the two throats 6 are connected to each other, toward the grip 10. The shaft 8 is formed so as to be integrally connected to the throats 6. The grip 10 is formed so as to be integrally connected to the shaft 8. The portion of the head 4 that is sandwiched between the two throats 6 is a yoke 12.

Each of the head 4, the throats 6, and the shaft 8 is composed of a plurality of laminated prepregs. Each prepreg is made of a fiber reinforced resin. The fiber reinforced resin is formed by impregnating a reinforced fiber with a matrix resin. Specifically, for example, the reinforced fiber is wound on a drum such that the fibrous direction of the reinforced fiber is made uniform, while being impregnated with the matrix resin. After a certain amount of the reinforced fiber is wound, the fiber reinforced resin is cut out from the drum. Then, the cut fiber reinforced resin is heated at about 80° C. to 100° C. to be pseudo-cured to obtain a prepreg. The matrix resin is, for example, an epoxy resin. The reinforced fiber is, for example, a carbon fiber. The reinforced fiber is a long fiber.

Each of the head 4, the throats 6, and the shaft 8 is formed from a laminate obtained by winding a plurality of prepregs. The head 4, the throats 6, and the shaft 8 are formed from a single continuous laminate. The laminate is hollow. In order to mold the laminate into the shapes of the head 4, the throats 6, and the shaft 8, the laminate is set in a mold. The laminate is heated within the mold, and at the same time, air is injected into the inside of the laminate to pressurize and retain the laminate. By this heating/pressurizing molding, the epoxy resin is cured to form the head 4, the throats 6, and the shaft 8.

In FIG. 1, a point P1 indicates a point where the yoke 12 and the throat 6 are connected to each other. A point P2 indicates a point where one throat 6 is connected to the other throat 6. A double ended arrow D indicates the distance from the point P1 to the point P2. The distance D is measured in the axial direction of the racket frame 2. A point P3 is a point indicating the position of the center of the throat 6. The point P3 is obtained as an intersection point between the throat 6 and a straight line that extends so as to pass through the midpoint of the distance D and be orthogonal to the axis of the racket frame 2. A chain double-dashed line L1 indicates a cross section of the throat 6 that passes through the point P1. A chain double-dashed line L2 indicates a cross section of the throat 6 that passes through the point P2. A chain double-dashed line L3 indicates a cross section of the throat 6 that passes through the point P3. The cross sections L1, L2, and L3 are orthogonal to the longitudinal direction of the throat 6.

The cross section L1 indicates a head 4 side end of the throat 6. The cross section L2 indicates a shaft 8 side end of the throat 6. The cross section L3 indicates the center of the throat 6.

As shown in FIG. 2, a groove 14 is formed in the throat 6. The groove 14 is formed in an outer peripheral surface of the throat 6 in the lateral direction thereof. The groove 14 extends along the longitudinal direction of the throat 6. The groove 14 extends from the head 4 side end of the throat 6 to the shaft 8 side end of the throat 6. In the racket frame 2, a gut groove 16 is formed in the outer peripheral surface of the head 4. The gut groove 16 extends to the head 4 side end of the throat 6. The groove 14 is formed on the outer side of the racket frame 2 in the lateral direction thereof. The groove 14 is formed so as to be connected to the gut groove 16. The groove 14 is formed together with the gut groove 16 by the above-described heating/pressurizing molding. The groove 14 may not necessarily be connected to the gut groove 16. Here, the groove 14 formed in one of the throats 6 has been described. However, a groove 14 is also similarly formed in the other throat 6.

Figure 3:
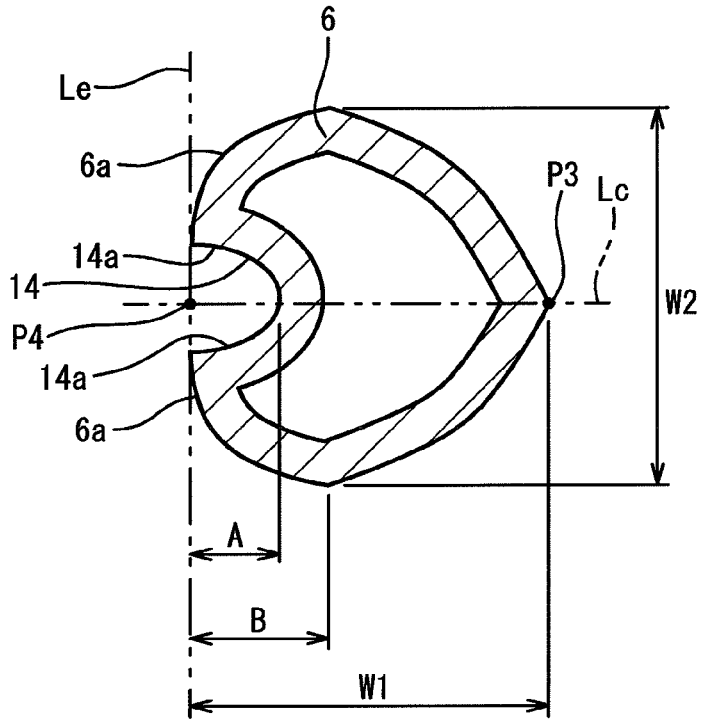
FIG. 3 is an enlarged cross-sectional view taken along the line in FIG. 1.

FIG. 3 shows the cross section L3 of the center of the throat 6. In FIG. 3, a lamination structure of the prepregs is omitted in the cross section L3. A description will be given in which, for convenience of explanation, in the cross section L3, the right-to-left direction parallel to the ball-hitting face is referred to as a right-left width direction and a top-to-bottom direction orthogonal to the ball-hitting face is referred to as a front-back width direction. The cross section L3 is a cross section that is orthogonal to the longitudinal direction of the throat 6 and the ball-hitting face. A chain double-dashed line Lc is a center line of the cross section L3 that extends in the right-left width direction. A chain double-dashed line Le is a straight line passing through one end of the cross section L3 in the right-left width direction. The straight line Le is a straight line passing through a pair of intersection points between a wall surface 14*a* of the groove 14 and a surface 6*a* of the throat 6. A point P4 is an intersection point between the straight line Lc and the straight line Le.

In FIG. 3, a double ended arrow W1 indicates the distance from the point P4 to the point P3. The distance W1 is the width of the throat 6 in the right-left width direction. The right-left width W1 is the maximum width in the right-to-left direction in the cross section of FIG. 3. The right-left width W1 is measured along the straight line Lc in the cross section of FIG. 3. The point P4 indicates one end of the throat 6 in the right-left width W1 direction. The point P3 indicates the other end of the throat 6 in the right-left width W1 direction.

A double ended arrow W2 indicates the width of the throat 6 in the front-back width direction. The front-back width W2 is measured along a direction orthogonal to the straight line Lc in the cross section L3. The front-back width W2 is the maximum width of the throat 6 in the front-back width direction.

A double ended arrow A indicates the depth of the groove 14. The bottom of the groove 14 is formed as a circular-arc-shaped curved surface in the cross section L3. The depth A is measured as the distance from the point P4 to the deepest position at the bottom of the groove 14. A double ended arrow B indicates the distance from the point P4 at the one end to the position at the front-back width W2 in the right-left width direction in the cross section of FIG. 3. The depth A and the distance B are measured along the straight line Lc.

Figure 4:
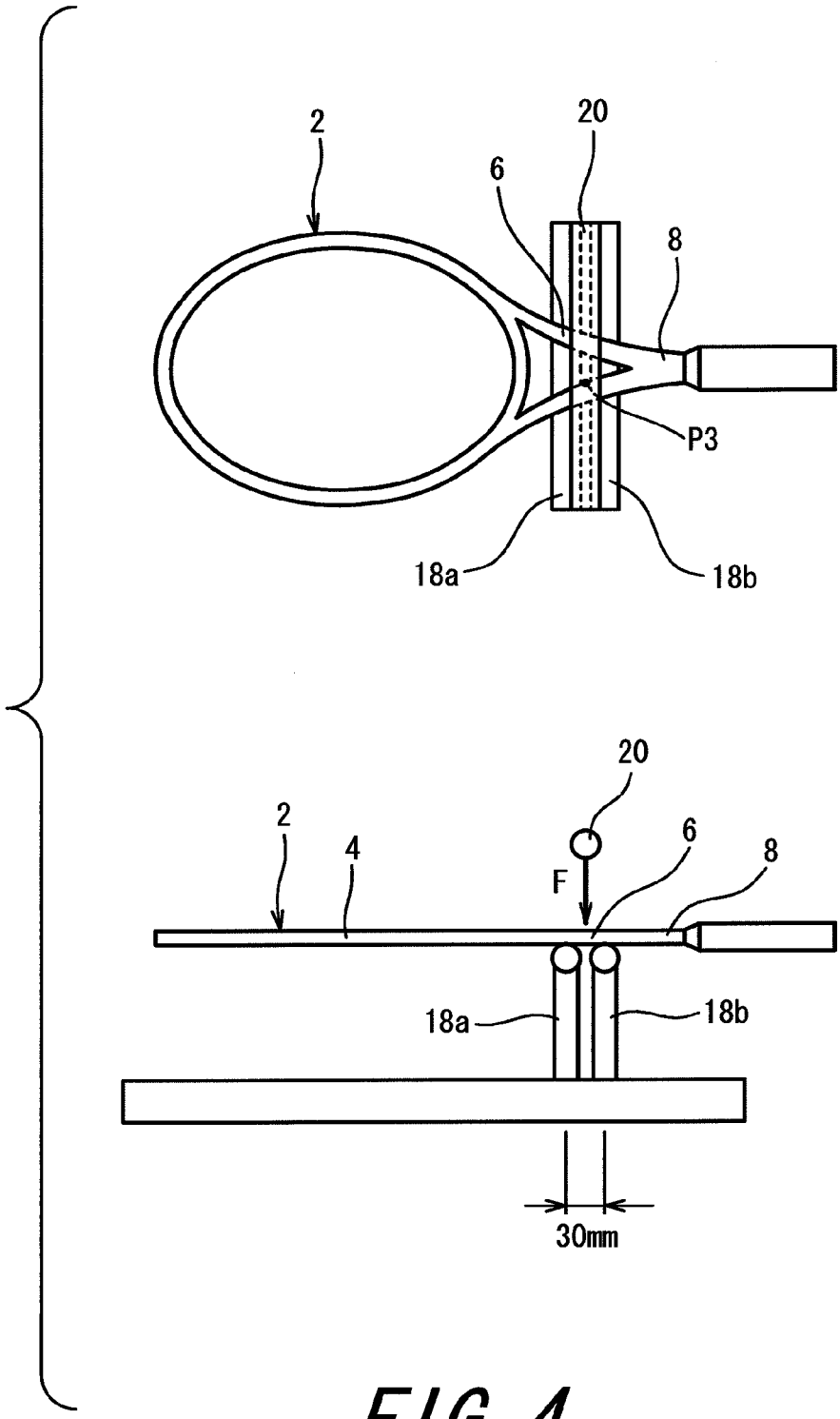
FIG. 4 is a schematic diagram showing a situation in which a compressive rigidity of throats of the racket frame in FIG. 1 is measured.

FIG. 4 is a schematic diagram showing a situation in which a compressive rigidity is measured. In FIG. 4, a compressive rigidity of the throats 6 of the racket frame 2 is measured. The compressive rigidity is a rigidity in the front-back width direction in which the throats 6 are squeezed. For the measurement of the compressive rigidity, two receiving tools 18 made of steel are used. Each receiving tool 18 has a bar shape. A cross-sectional shape of each receiving tool 18 is a circle having a radius of 5 mm. The first receiving tool 18*a* is located at a distance of 15 mm from the point P3 at the center of the throat 6 toward the head 4. The second receiving tool 18*b* is located at a distance of 30 mm from the first receiving tool 18*a* toward the shaft 8. The racket frame 2 is disposed on these receiving tools 18 such that the throats 6 extend horizontally and the ball-hitting face extends horizontally. Meanwhile, a compressing tool 20 made of steel is prepared. The compressing tool 20 has a bar shape. A cross-sectional shape of the compressing tool 20 is a circle having a radius of 5 mm. The compressing tool 20 moves at a speed of 30 mm/min in the direction of an arrow F. The compressing tool 20 presses the throats 6 at an equal distance from the first receiving tool 18*a* and the second receiving tool 18*b*. Due to this pressing, a load is applied to the racket frame 2. The load gradually increases, and the compressing tool 20 moves in the direction of the arrow F. A movement distance X (mm) of the compressing tool 20 from the state in which the load is 25 kgf to the state in which the load is 50 kgf is measured. A value obtained by dividing 25 kgf, which is a change amount of the load, by X is the compressive rigidity. The measurement of the compressive rigidity is conducted in a state in which the grommet is attached to the racket frame 2 and the gut is not mounted on the racket frame 2.

In the racket frame 2, the depth direction of the groove 14 is parallel to the ball-hitting face. When the load is applied by the compressing tool 20, the throats 6 easily elastically deform in the front-back width direction, since the groove 14 is formed in each throat 6. The compressive rigidity of the throats 6 in the front-back width direction is decreased as compared to that of a conventional racket frame.

As a result of various trials and errors, the inventors have found that by decreasing the compressive rigidity of the throats 6 in the front-back width direction, favorable holding feel is obtained in the racket frame 2. A racket in which the racket frame 2 has a low compressive rigidity has excellent ball-holding feel. In this respect, the compressive rigidity is preferably equal to or less than 2600 kgf/mm, more preferably equal to or less than 2300 kgf/mm, and particularly preferably equal to or less than 2100 kgf/mm.

Figure 5:
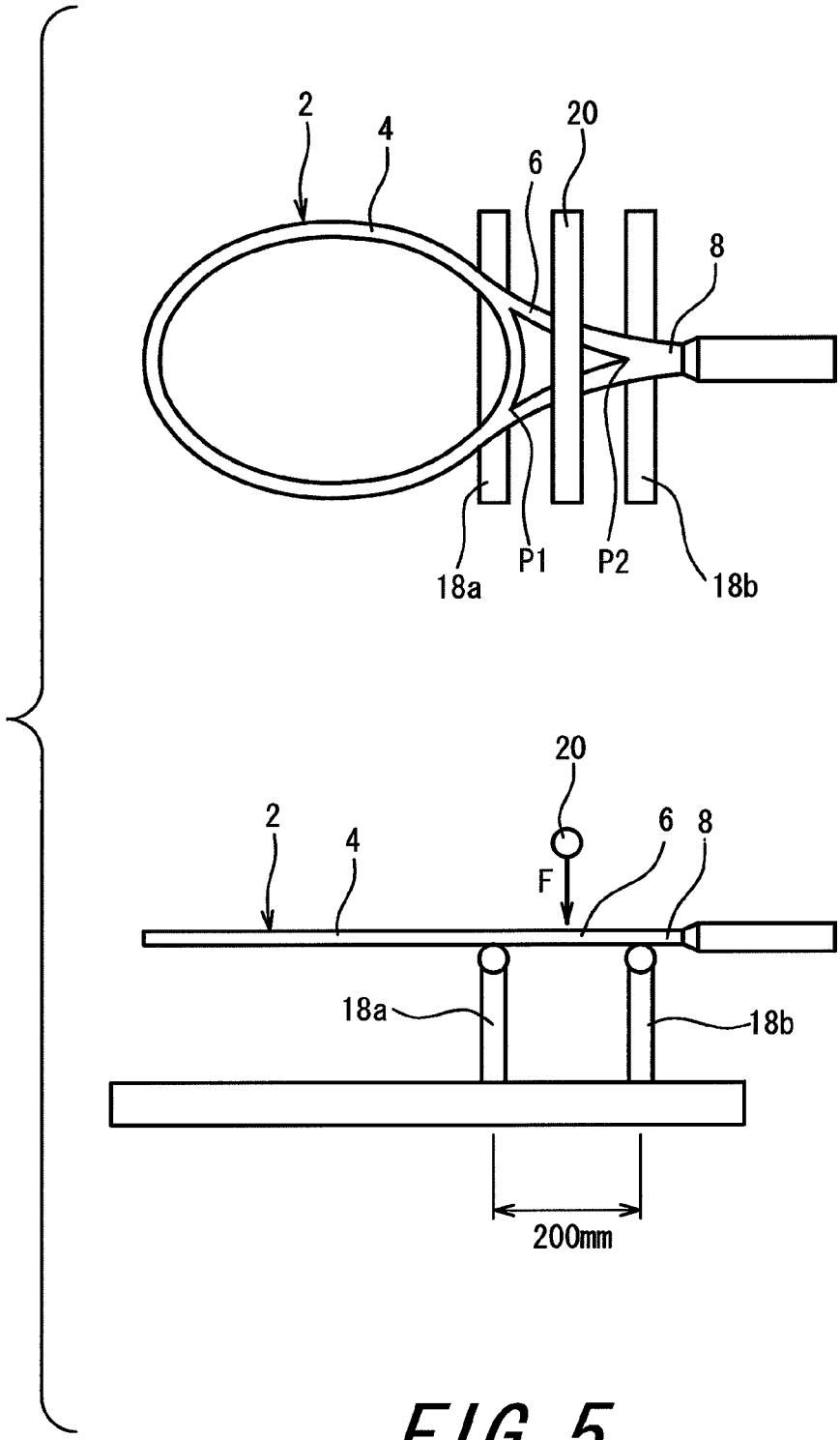
FIG. 5 is a schematic diagram showing a situation in which a flexural rigidity of the throats of the racket frame in FIG. 1 is measured.

FIG. 5 is a schematic diagram showing a situation in which a flexural rigidity is measured. In FIG. 5, a flexural rigidity of the throats 6 of the racket frame 2 is measured. For the measurement of the flexural rigidity, two receiving tools 18 made of steel are used. Each receiving tool 18 has a bar shape. A cross-sectional shape of each receiving tool 18 is a circle having a radius of 5 mm. The first receiving tool 18*a* is located on the head 4 side of the point P1 at the head 4 side end of the throat 6 in the axial direction of the racket frame 2. The second receiving tool 18*b* is located on the shaft 8 side of the point P2 at the shaft 8 side end of the throat 6. The interval between the first receiving tool 18*a* and the second receiving tool 18*b* is set to 200 mm. The racket frame 2 is disposed on these receiving tools 18 such that the throats 6 extend horizontally and the ball-hitting face extends horizontally. Meanwhile, a compressing tool 20 made of steel is prepared. The compressing tool 20 has a bar shape. A cross-sectional shape of the compressing tool 20 is a circle having a radius of 5 mm. The compressing tool 20 moves at a speed of 30 mm/min in the direction of an arrow F. The compressing tool 20 presses the throats 6 at an equal distance from the first receiving tool 18*a* and the second receiving tool 18*b*. Due to this pressing, a load is applied to the racket frame 2. The load gradually increases, and the compressing tool 20 moves in the direction of the arrow F. A movement distance X (mm) of the compressing tool 20 from the state in which the load is 25 kgf to the state in which the load is 50 kgf is measured. A value obtained by dividing 25 kgf, which is a change amount of the load, by X is the flexural rigidity of the throats 6. The measurement of the flexural rigidity is conducted in a state in which the grommet is attached to the racket frame 2 and the gut is not mounted on the racket frame 2.

In the throats 6, the grooves 14 do not greatly deteriorate the flexural rigidity in a high load range. Since the flexural rigidity is not deteriorated, the racket frame 2 can exhibit resilience at the same level as a conventional racket frame. Due to this, the racket frame 2 can improve holding feel without deteriorating so-called rebounding performance.

In light of decreasing the compressive rigidity of the throats 6, each groove 14 is formed so as to extend from the head 4 side end of the throat 6 to a position beyond the point P3 and the point P4 in FIG. 3. In other words, each groove 14 is formed so as to extend from the head 4 side end of the throat 6 to a position on the shaft 8 side beyond the center in the longitudinal direction. In light of decreasing the compressive rigidity, each groove 14 is preferably formed so as to extend to the shaft 8 side end of the throat 6.

The deeper each groove 14 is, the lower the compressive rigidity of the throats 6 is. In this respect, the depth A of each groove 14 is preferably equal to or greater than 2 mm. On the other hand, when each groove 14 is excessively deep, the compressive rigidity of the throats 6 is greatly deteriorated. If the compressive rigidity of the throats 6 excessively decreases, the rigidity of the racket frame 2 becomes insufficient. Due to the insufficiency of the rigidity, holding feel at impact is deteriorated. In this respect, the depth A of each groove 14 is preferably equal to or less than 6 mm and more preferably equal to or less than 4 mm.

In the racket frame 2, the cross-sectional shape of each throat 6 is asymmetrical in the right-left width direction as shown in FIG. 3. The front-back width of the throat 6 gradually increases from the point P4, which is one end at the right-left width W1, toward the point P3 which is the other end at the right-left width W1. After reaching the front-back width W2 which is the maximum value, the front-back width of the throat 6 gradually decreases toward the point P3. The position at the front-back width W2 is closer to the point P4 than to the point P3 in the right-left width direction. Each groove 14 is formed on the one end side. The direction of the depth A of the groove 14 coincides with the right-left width W1 direction. The cross-sectional shape of each throat 6 and each groove 14 allow the compressive rigidity of the throats 6 to be effectively decreased without deteriorating the rigidity in the high load range.

Further, in the racket frame 2, each groove 14 is formed so as to be connected to the gut groove 16, and thus the compressive rigidity of the throats 6 can be effectively decreased with the small grooves 14.

The greater the ratio (A/B) of the depth A of each groove 14 and the distance B is, the lower the compressive rigidity of the throats 6 is. In this respect, the ratio (A/B) is preferably equal to or greater than 0.17 and more preferably equal to or greater than 0.33. On the other hand, when the ratio (A/B) is excessively great, the flexural rigidity of the throats 6 is greatly deteriorated. If the flexural rigidity of the throats 6 is greatly deteriorated, the rigidity of the racket frame 2 decreases. In this respect, the ratio (A/B) is preferably less than 1.0, more preferably equal to or less than 0.83, and particularly preferably equal to or less than 0.67.

Here, a method for measuring a flexural rigidity from a low load range to a high load range will be described. In this method, two receiving tools 18*a* and 18*b* made of steel and a compressing tool 20 made of steel are used similarly as in the flexural rigidity measuring method shown in FIG. 5. The interval between the receiving tools 18*a* and 18*b* is 200 mm. The compressing tool 20 moves at a speed of 30 mm/min in the direction of the arrow F in FIG. 5. The compressing tool 20 presses the throats 6. Due to this pressing, a load is applied to the racket frame 2. The load gradually increases, and the compressing tool 20 moves in the direction of the arrow F. A movement distance X1 (mm) of the compressing tool 20 from the state in which the load is 5 kgf to the state in which the load is 15 kgf is measured. A value obtained by dividing 10 kgf, which is a change amount of the applied load, by the movement distance X1 at that time is a flexural rigidity $G_{15}$ in the low load range (from 5 kgf to 15 kgf). The measurement of the flexural rigidity $G_{15}$ is conducted in a state in which the grommet is attached to the racket frame 2 and the gut is not mounted on the racket frame 2.

Similarly, a movement distance X2 (mm) of the compressing tool 20 from the state in which the load is 15 kgf to the state in which the load is 25 kgf is measured. A flexural rigidity $G_{25}$ is obtained by dividing 10 kgf, which is a change amount of the applied load, by the movement distance X2 at that time. Moreover, similarly, a flexural rigidity $G_{35}$ from the state in which the load is 25 kgf to the state in which the load is 35 kgf, a flexural rigidity $G_{45}$ from the state in which the load is 35 kgf to the state in which the load is 45 kgf, and a flexural rigidity $G_{55}$ in the high load range (from 45 kgf to 55 kgf) from the state in which the load is 45 kgf to the state in which the load is 55 kgf are obtained.

In the racket frame 2, by decreasing the compressive rigidity of the throats 6, the flexural rigidity $G_{15}$ of the throats 6 in the low load range is decreased. On the other hand, a decrease in the flexural rigidity $G_{55}$ of the throats 6 in the high load range is suppressed.

In the racket frame 2 in which the flexural rigidity $G_{15}$ of the throats 6 is low, soft hitting feel is obtained. In this respect, the flexural rigidity $G_{15}$ is equal to or less than 900 kgf/mm, preferably equal to or less than 850 kgf/mm, and more preferably equal to or less than 800 kgf/mm. On the other hand, in the racket frame 2 in which the flexural rigidity $G_{15}$ is high, high resilience is obtained. In particular, in the racket frame 2 in which the flexural rigidity $G_{15}$ is excessively low, the resilience becomes insufficient. In the racket frame 2, the holding feel is deteriorated. In this respect, the flexural rigidity $G_{15}$ is equal to or greater than 600 kgf/mm, preferably equal to or greater than 650 kgf/mm, and more preferably equal to or greater than 700 kgf/mm.

The racket frame 2 in which the flexural rigidity $G_{55}$ of the throats 6 is high has excellent resilience. In this respect, the flexural rigidity $G_{55}$ of the throats 6 is equal to or greater than 900 kgf/mm, preferably equal to or greater than 950 kgf/mm, and more preferably equal to or greater than 1000 kgf/mm. On the other hand, in the racket frame 2 in which the flexural rigidity $G_{55}$ is excessively high, hard hitting feel is obtained. In this respect, the flexural rigidity $G_{55}$ is equal to or less than 1200 kgf/mm, preferably equal to or less than 1150 kgf/mm, and more preferably equal to or less than 1100 kgf/mm.

In the racket frame 2, the rigidity ratio ($G_{15}/G_{55}$) of the flexural rigidity $G_{15}$ of the throats 6 in the low load range and the flexural rigidity $G_{55}$ of the throats 6 in the high load range is decreased as compared to that of a conventional racket frame.

By decreasing the rigidity ratio ($G_{15}/G_{55}$), both high resilience and soft hitting feel can be obtained. In this respect, the rigidity ratio ($G_{15}/G_{55}$) is preferably equal to or less than 0.85. From the standpoint that high resilience and soft hitting feel are obtained in a well-balanced manner, more preferably, the rigidity ratio ($G_{15}/G_{55}$) is equal to or greater than 0.70 but equal to or less than 0.80.

In the racket frame 2, the compressive rigidity, the flexural rigidity $G_{15}$, and the flexural rigidity $G_{55}$ of the throats 6 are adjusted by forming the grooves 14. However, the compressive rigidity, the flexural rigidity $G_{15}$, and the flexural rigidity $G_{55}$ of the throats 6 may be adjusted by another means, for example, by means of the lamination structure of the prepregs for the head, the throats, and the shaft.

Figure 6:
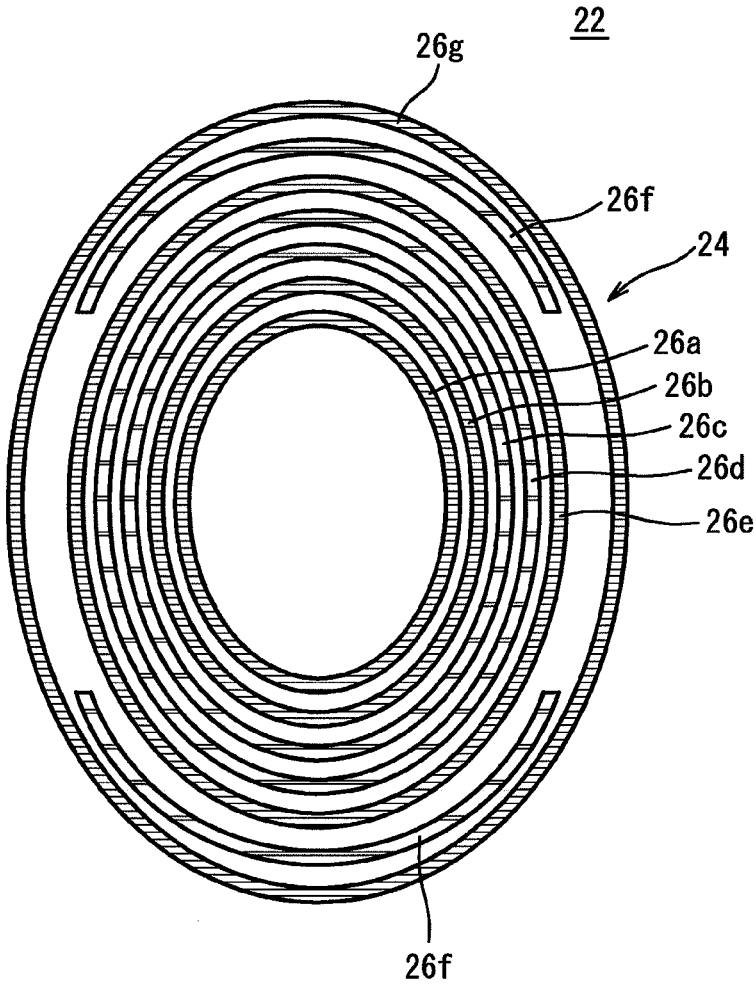
FIG. 6 is a diagram illustrating a cross-sectional structure of a throat of a racket frame according to another embodiment of the present invention.

FIG. 6 shows a cross-sectional structure of a throat 24 of a racket frame 22 according to another embodiment of the present invention. The racket frame 22 is an example in which a lamination structure of prepregs for a head, the throats 24, and a shaft is adjusted. In FIG. 6, the top-to-bottom direction is a front-back width direction of the racket frame 22, and the right-to-left direction is a right-left width direction of the racket frame 22. A cross-sectional outer shape of each throat 24 is a substantially elliptical shape. In the substantially elliptical shape, the front-back width direction corresponds to a major axis, and the right-left width direction corresponds to a minor axis.

A portion of the racket frame 22 from the head to the shaft including the throats 24 is formed by laminating eight prepregs 26. The eight prepregs 26 include prepregs 26*a*, 26*b*, 26*e*, and 26*g* in which the reinforced fibers extend so as to be inclined at an angle of 30° with respect to the longitudinal direction, and prepregs 26*c* and 26*d* and a pair of prepregs 26*f* in all of which the reinforced fibers extend in the longitudinal direction.

The portion of the racket frame 22 from the head to the shaft is formed from a single continuous laminate. In the laminate, the prepreg 26*b* is wound on the outer circumference of the prepreg 26*a* that is wound in a pipe shape. The prepreg 26*c* is wound on the outer circumference of the prepreg 26*b*. Further, the prepregs 26*d* and 26*e* are laminated in order from the inside toward the outside. The pair of prepregs 26*f* is laminated on the outer circumferential surface of the prepreg 26*e*. One of the prepregs 26*f* is laminated on a front portion of the outer circumferential surface of the prepreg 26*e* in the front-back width direction. The other prepreg 26*f* is laminated on a back portion of the outer circumferential surface of the prepreg 26*e* in the front-back width direction. Each prepreg 26*f* is laminated so as to cover about ⅓ of the outer circumference of the prepreg 26*e*. The prepreg 26*g* is laminated so as to cover the outer circumferences of the prepreg 26*e* and the pair of prepregs 26*f*. In this manner, the laminate is formed.

The laminate is set in a mold. The laminate is heated within the mold, and at the same time, air is injected into the inside of the laminate to pressurize and retain the laminate. By the heating/pressurizing molding, the epoxy resin is cured to form the throats 24 together with the head and the shaft. In this manner, the throats 24 each having the cross-sectional structure shown in FIG. 6 are formed.

The number of the prepregs laminated in each throat 24 is reduced as compared to that in a conventional racket frame. The difference between the number of the prepregs laminated in the throat 24 in the front-back width direction and the number of the prepregs laminated in the throat 24 in the right-left width direction is reduced. As compared to a conventional racket frame, the rigidity is made uniform in all directions including the front-back width direction and the right-left width direction in the cross section of the throat 24. Thus, the compressive rigidity of the throats 24 in the front-back direction is decreased. In the racket frame, favorable holding feel can be obtained at impact.

In the racket frame 22 as well, by decreasing the compressive rigidity of the throats 24, the flexural rigidity $G_{15}$ of the throats 24 in the low load range is decreased.

In the racket frame 22, the lamination structure of the prepregs is changed, but the amount of the reinforced fiber that constitutes the prepregs of the lamination structure is the same as the amount of the reinforced fiber in a conventional racket frame. Thus, the flexural rigidity of the throats 24 in the high load range in which the entire throats 24 deform is not greatly deteriorated. After deformation in the low load range, the racket frame 22 exhibits a relatively high rigidity in the high load range. In the racket frame 22, the flexural rigidity in the high load range is not greatly deteriorated. The racket frame 22 can exhibit resilience at the same level as a conventional racket frame.

Here, the racket frame 22 has been described as an example, but the lamination structure of the prepregs is not limited to that in the racket frame 22. In the present invention, the lamination structure of the prepregs suffices to be adjusted such that the flexural rigidity $G_{15}$ in the low load range is equal to or greater than 600 kgf/mm but equal to or less than 900 kgf/mm, the flexural rigidity $G_{55}$ in the high load range is equal to or greater than 900 kgf/mm but equal to or less than 1200 kgf/mm, and the ratio ($G_{15}/G_{55}$) of the flexural rigidity $G_{15}$ and the flexural rigidity $G_{55}$ is equal to or greater than 0.70 but equal to or less than 0.85.

For example, the directions in which the reinforced fibers of the laminated prepregs extend may be changed. In addition, the ratio of the number of prepregs whose reinforced fibers extend in the longitudinal direction of the throat and the number of prepregs whose reinforced fibers extend so as to be inclined with respect to the longitudinal direction may be changed. Further, the numbers of the prepregs laminated in the right-left width direction and the front-back width direction of the throat may be changed independently.

Moreover, in the laminate, a difference in structure between a portion where the head is formed and a portion where the throats are formed may be provided. For example, the number of prepregs laminated in the portion where the throats are formed may be made smaller than the number of prepregs laminated in the portion where the head is formed. The direction in which the reinforced fibers of the prepregs in the portion where the throats are formed extend may be changed so as to be different from the direction in which the reinforced fibers of the prepregs in the portion where the head is formed extend. The direction in which the reinforced fibers in the portion where the throats are formed extend may be greatly inclined with respect to the longitudinal direction so as to be different from that in the portion where the head is formed.

EXAMPLES

The following will show the effects of the present invention by means of Examples, but the present invention should not be construed in a limited manner based on the description of these Examples.

Comparative Example 1

Figure 7:
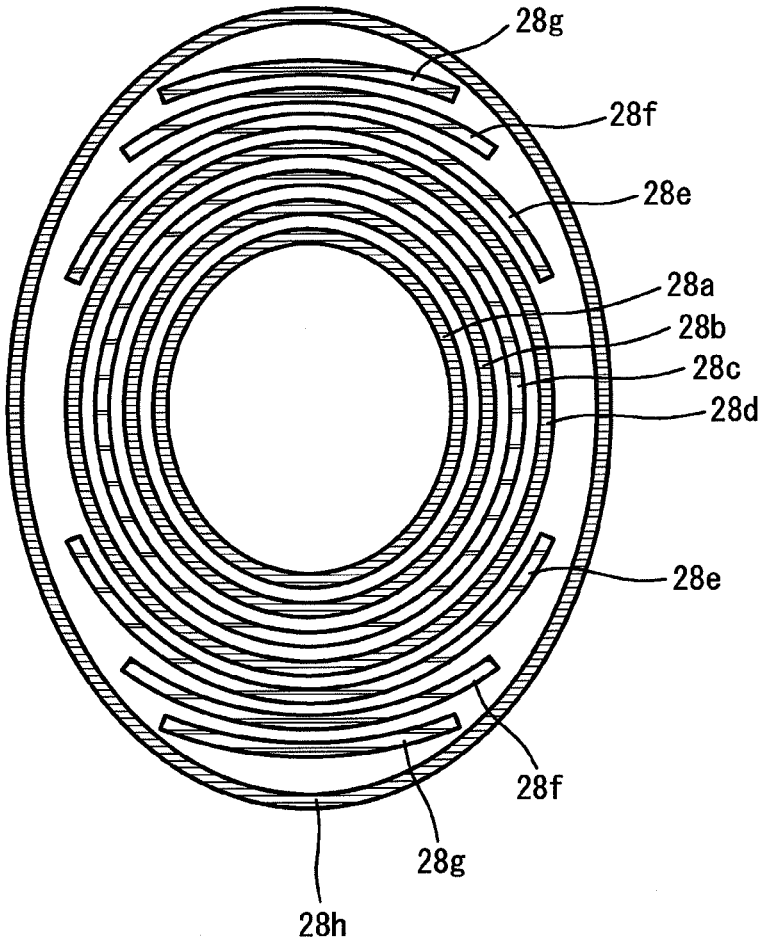
FIG. 7 is a diagram illustrating a cross-sectional structure of a throat of a racket frame of a comparative example.

A racket frame was obtained in the same manner as the racket frame shown in FIGS. 1 to 3, except the cross-sectional structure and the cross-sectional outer shape of each throat were as shown in FIG. 7. The racket frame is the same as in Example 1 described later, except the cross-sectional structure and the cross-sectional outer shape of each throat were as shown in FIG. 7. The area of the ball-hitting face of the racket frame was set to 100 square inch. The frame weight and the frame balance were set to 300 g/320 mm.

In the racket frame, the head, the throats, and the shaft were formed from a laminate in which eleven prepregs 28 are laminated. In the prepregs 28, a carbon fiber was used as the reinforced fiber, and an epoxy resin was used as the matrix resin. The prepregs 28 were laminated on a mandrel coated with an internal pressure tube made of 66 nylon, and the laminate was molded. The laminate was composed of prepregs 28*a*, 28*b*, 28*d*, and 28*h* in which the reinforced fibers extended so as to be inclined at an angle of 30° with respect to the longitudinal direction, and a prepreg 28*c*, a pair of prepregs 28*e*, a pair of prepregs 28*f*, and a pair of prepregs 28*g* in all of which the reinforced fibers extended in the longitudinal direction.

In the laminate, the prepreg 28*b* was wound on the outer circumference of the prepreg 28*a* that was wound in a pipe shape. Further, the prepregs 28*c* and 28*d* were laminated in order from the inside toward the outside. The pair of prepregs 28*e* was laminated on the outer circumference of the prepreg 28*d*. One of the prepregs 28*e* was laminated on a front portion of the outer circumferential surface of the prepreg 28*d* in the front-back width direction. The other prepreg 28*e* was laminated on a back portion of the outer circumferential surface of the prepreg 28*d* in the front-back width direction. Each prepreg 28*e* covered about ⅓ of the outer circumference of the prepreg 28*d*. Further, the pair of prepregs 28*f* and the pair of prepregs 28*g* were laminated on the outer circumferences of the pair of prepregs 28*e* from the inside toward the outside. Each of the prepregs 28*f* and 28*g* covers about ¼ of the outer circumference. Moreover, the prepreg 28*h* was laminated on the outer side to cover the entire outer circumferential surface.

The laminate was set in a mold. The mold was clamped, and the laminate was pressurized and retained at 150° C. to conduct heating/pressurizing molding. By this heating/pressurizing molding, the laminate was molded into the head, a pair of the throats, and the shaft. By this heating/pressurizing molding, each throat was formed so as to have the cross-sectional outer shape shown in FIG. 7.

Example 1

Figure 8A:
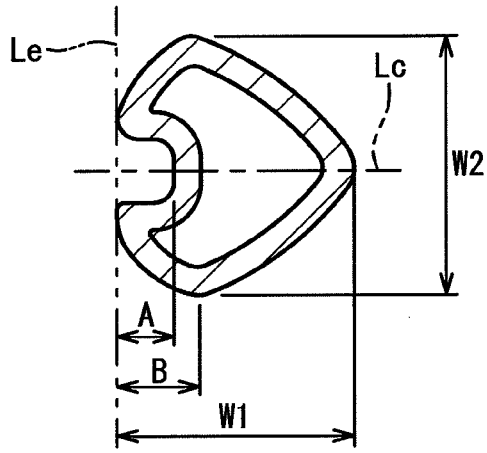
FIG. 8A is a diagram illustrating a throat cross section of a racket frame of an example.

The racket frame shown in FIGS. 1 to 3 was manufactured. FIG. 8A shows a cross-sectional shape at the center of the throat of the racket frame in the longitudinal direction. The cross section is a cross section perpendicular to the longitudinal direction of the throat. In the racket frame, the right-left width W1 was 18 mm, the front-back width W2 was 22 mm, and the distance B was 6 mm. The depth A of the groove at the center of each throat was set to 4 mm.

For the racket frame, a laminate that is the same as in Comparative Example 1 was used. The laminate was clamped with a mold and pressurized and retained at 150° C. to conduct heating/pressurizing molding. By this heating/pressurizing molding, a head, a pair of throats, and a shaft were molded. By this heating/pressurizing molding, each throat was formed so as to have the cross-sectional shape shown in FIG. 8A. Although not shown, prepregs 28*e*, 28*f*, and 28*g* were laminated on an outer circumferential surface in the front-back width direction of the cross section, similarly as in Comparative Example 1. The racket frame was obtained in the same manner as Comparative Example 1, except the cross-sectional shape of each throat was different.

Examples 2 and 3

Racket frames were obtained in the same manner as Example 1, except the depth A of each groove was as shown in Table 1.

Example 4

A racket frame having the throat cross-sectional structure shown in FIG. 6 was manufactured. The racket frame was obtained in the same manner as Example 1, except the lamination structure of the prepregs and the cross-sectional structure and the cross-sectional outer shape of each throat were as shown in FIG. 6. In each throat, the number of prepregs laminated in the front-back width direction is small as compared to each throat in Comparative Example 1. On the other hand, in each throat, the number of prepregs laminated in the right-left width direction is large as compared to each throat in Comparative Example 1. In each throat, the difference between the number of the prepregs laminated in the front-back width direction and the number of the prepregs laminated in the right-left width direction is reduced.

Comparative Example 2

Figure 8B:
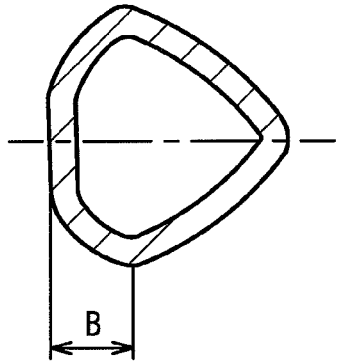
FIG. 8B is a diagram illustrating a throat cross section of a racket frame of another comparative example.

A racket frame was obtained in the same manner as Example 1, except the cross-sectional shape at the center of each throat in the longitudinal direction was as shown in FIG. 8B. As shown in FIG. 8B, the racket frame was formed in a shape in which no groove is formed in the cross-sectional outer shape in Example 1.

[Compressive Rigidity Evaluation]

Figure 9:
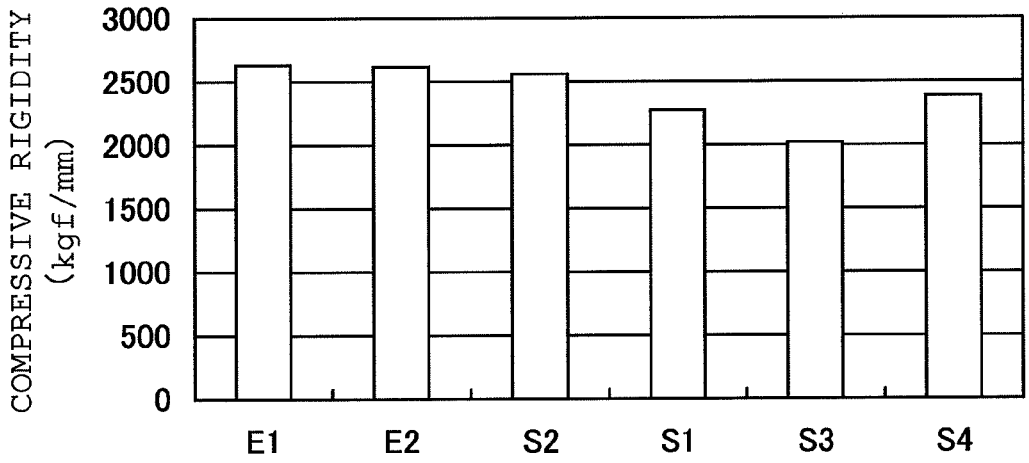
FIG. 9 is a graph showing compressive rigidities of examples and the comparative examples.

The compressive rigidity of the throats was evaluated for the racket frames of Examples 1 to 4 and Comparative Examples 1 and 2. In the compressive rigidity evaluation, compressive rigidities were measured by the test method shown in FIG. 4. The results are shown in Table 1 and FIG. 9. In FIG. 9, S1 indicates the racket frame of Example 1. S2 indicates the racket frame of Example 2, S3 indicates the racket frame of Example 3, and S4 indicates the racket frame of Example 4. E1 indicates the racket frame of Comparative Example 1, and E2 indicates the racket frame of Comparative Example 2.

As shown in Table 1 and FIG. 9, the compressive rigidities of Examples 1 to 3 in which the groove was formed in each throat are decreased. In addition, the compressive rigidity of Example 4 in which the lamination structure of the prepregs in each throat was adjusted is decreased. Due to the decrease in compressive rigidity, favorable holding feel can be obtained.

[Flexural Rigidity Evaluation]

Figure 10:
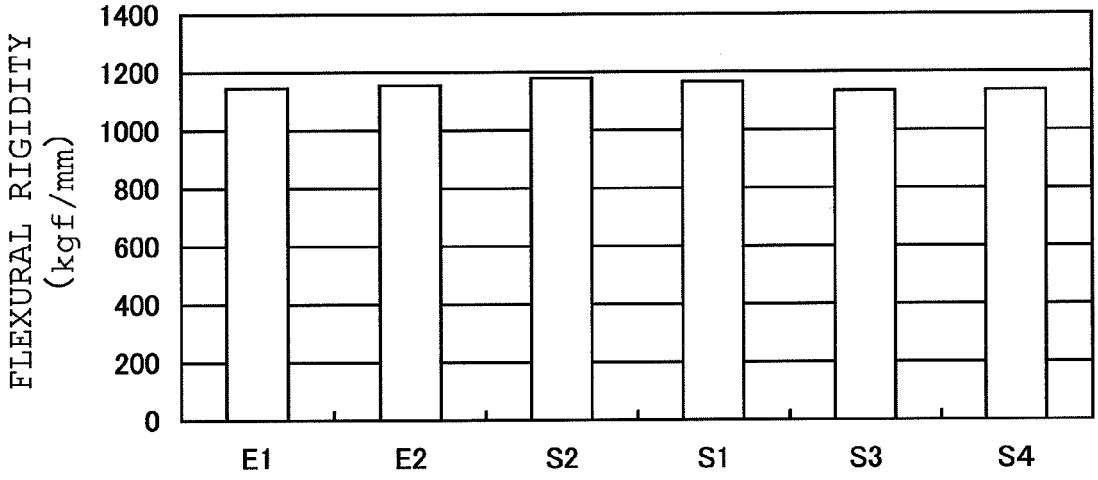
FIG. 10 is a graph showing flexural rigidities of the examples and the comparative examples.

The flexural rigidity of the throats was evaluated for the racket frames of Examples 1 to 4 and Comparative Examples 1 and 2. In the flexural rigidity evaluation, flexural rigidities were measured by the test method shown in FIG. 5. The results are shown in FIG. 10. In FIG. 10, the meanings of S1, S2, S3, S4, E1, and E2 are the same as in FIG. 9.

As shown in FIG. 10, the flexural rigidities of Examples 1 to 4 are nearly equal to the flexural rigidities of Comparative Examples 1 and 2. In Examples 1 to 4, the flexural rigidities are not decreased as compared to the compressive rigidities described above. Thus, the racket frames of Examples 1 to 4 also can exhibit high resilience.

[Sensuous Evaluation]

Grommets, grip tapes, end caps, and guts were mounted onto the racket frames to produce tennis rackets. Thirty advanced players conducted rallies with the tennis rackets, and relative evaluation was conducted regarding hitting feel, rebounding performance, and holding feel. Here, the hitting feel was evaluated on the basis of soft hitting feel. The results are shown in Table 1 below. The evaluation was categorized into four evaluation levels. Evaluation A represents being particularly excellent. Evaluation B represents being slightly excellent. Evaluation C represents being at an ordinary level. Evaluation D represents being slightly inferior. Evaluation C is a standard level. Evaluations C and D are levels at which it is possible to put the tennis rackets on the market.

TABLE 1

Result of Evaluation

| | Compara. Exam. 1 | Compara. Exam. 2 | Exam. 2 | Exam. 1 | Exam. 3 | Exam. 4 |
|---|---|---|---|---|---|---|
| Throat cross-sectional outer shape | FIG. 7 | FIG. 8B | FIG. 8A | FIG. 8A | FIG. 8A | FIG. 6 |
| Throat cross-sectional structure | FIG. 7 | FIG. 7 | FIG. 7 | FIG. 7 | FIG. 7 | FIG. 6 |
| Groove | None | None | Presence | Presence | Presence | None |
| Groove depth A (mm) | — | — | 2 | 4 | 6 | — |
| Distance B (mm) | — | 6 | 6 | 6 | 6 | — |
| Compressive rigidity (kgf/mm) | 2631 | 2617 | 2560 | 2276 | 2019 | 2384 |
| Hitting feel | C | C | B | B | B | B |
| Rebounding performance | A | A | A | B | B | A |
| Holding feel | C | C | B | A | A | B |

[Evaluation of Flexural Rigidity from Low Load Range to High Load Range]

Figure 11:
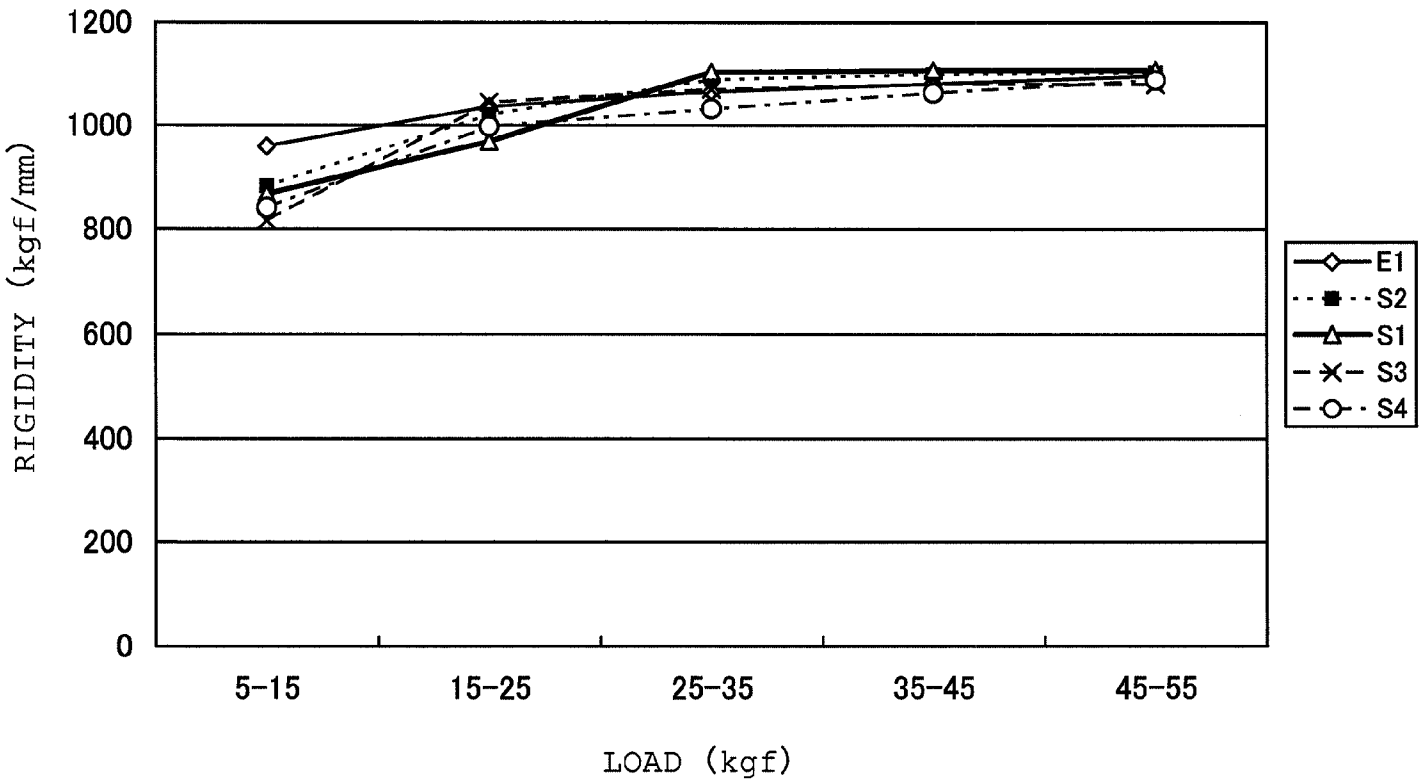
FIG. 11 is a graph showing the relationship between load and flexural rigidity in the examples and the comparative example.

The flexural rigidity of the throats in a low load range (5 kgf-15 kgf) to a high load range (45 kgf-55 kgf) was evaluated for the racket frames of Examples 1 to 4 and Comparative Example 1. In the flexural rigidity evaluation, flexural rigidities were measured by the already-described method for measuring a flexural rigidity from the low load range to the high load range. The results are shown in Table 2 below and FIG. 11. In FIG. 11, the meanings of S1, S2, S3, S4, and E1 are the same as in FIG. 9.

As shown in FIG. 11, in the low load range from 5 kgf to 15 kgf, the flexural rigidities of Examples 1 to 4 are lower than the flexural rigidity of Comparative Example 1. On the other hand, in the high load range from 45 kgf to 55 kgf, the flexural rigidities of Examples 1 to 4 are nearly equal to the flexural rigidity of Comparative Example 1. As shown in Table 2, the rigidity ratio ($G_{15}/G_{55}$) of the flexural rigidity $G_{15}$ in the low load range and the flexural rigidity $G_{55}$ in the high load range in each of Examples 1 to 4 is lower than that in Comparative Example 1. In the racket frames of Examples 1 to 4, both high resilience and soft hitting feel can be obtained.

TABLE 2

Result of Measurement

| | | Compara. Exam. 1 | Exam. 2 | Exam. 1 | Exam. 3 | Exam. 4 |
|---|---|---|---|---|---|---|
| Flexural rigidity (kgf/mm) | 5-15 | 960 | 884 | 869 | 817 | 842 |
| | 15-25 | 1036 | 1021 | 969 | 1045 | 998 |
| | 25-35 | 1065 | 1089 | 1104 | 1070 | 1032 |
| | 35-45 | 1080 | 1099 | 1108 | 1080 | 1063 |
| | 45-55 | 1095 | 1102 | 1108 | 1079 | 1088 |
| Rigidity ratio ($G_{15}/G_{55}$) | | 0.88 | 0.80 | 0.78 | 0.76 | 0.77 |

Comparative Examples 3 to 10

Commercially-available racket frames were prepared. For these racket frames, [Evaluation of Flexural Rigidity from Low Load Range to High Load Range] and [Sensuous Evaluation], which are described above, were conducted. The flexural rigidity $G_{15}$ in the low load range, the flexural rigidity $G_{55}$ in the high load range, the ratio ($G_{15}/G_{55}$) of the flexural rigidity $G_{15}$ and the flexural rigidity $G_{55}$, and the four-level sensuous evaluation are shown in Table 3.

TABLE 3

| Result of Evaluation | | | | | | | | | |
|---|---|---|---|---|---|---|---|---|---|
| | | Compara. Exam. 3 | Compara. Exam. 4 | Compara. Exam. 5 | Compara. Exam. 6 | Compara. Exam. 7 | Compara. Exam. 8 | Compara. Exam. 9 | Compara. Exam. 10 |
| Flexural rigidity (kgf/mm) | 5-15 | 665 | 904 | 948 | 1002 | 598 | 518 | 497 | 887 |
| | 45-55 | 969 | 1230 | 1782 | 1194 | 1278 | 634 | 800 | 996 |
| Rigidity ratio ($G_{15}/G_{55}$) | | 0.69 | 0.73 | 0.53 | 0.84 | 0.47 | 0.82 | 0.62 | 0.89 |
| Hitting feel | | B | C | D | C | A | A | A | C |
| Rebounding performance | | C | A | A | A | C | D | D | B |
| Holding feel | | A | B | D | C | B | A | B | C |

From the evaluation results of the racket frames of Comparative Examples 3 to 10 as well, advantages of Examples 1 to 4 are clear in achieving desired rebounding performance, desired hitting feel, and desired holding feel.

As shown in Tables 1 to 3, the racket frames of Examples are excellent in various performance characteristics. From the results of evaluation, advantages of the present invention are clear.

The above descriptions are merely for illustrative examples, and various modifications can be made without departing from the principles of the present invention.

What is claimed is:

1. A racket frame comprising a head, a shaft, and a pair of throats extending from the head to the shaft, wherein a flexural rigidity $G_{15}$ of the throats in a low load range (from 5 kgf to 15 kgf) is equal to or greater than 600 kgf/mm but equal to or less than 900 kgf/mm, a flexural rigidity $G_{55}$ of the throats in a high load range (from 45 kgf to 55 kgf) is equal to or greater than 900 kgf/mm but equal to or less than 1200 kgf/mm, and a rigidity ratio ($G_{15}/G_{55}$) of the flexural rigidity $G_{15}$ and the flexural rigidity $G_{55}$ is equal to or greater than 0.70 but equal to or less than 0.85.

2. The racket frame according to claim 1, wherein a groove is formed in each throat so as to extend from a head side toward a shaft side, a depth direction of the groove is parallel to a ball-hitting face, and the groove is formed so as to extend from a head side end of the throat to a shaft side beyond a center of the throat in a longitudinal direction thereof.

3. The racket frame according to claim 2, wherein in a cross section of each throat that is perpendicular to the longitudinal direction, a front-back width in a direction perpendicular to the ball-hitting face gradually increases from one end of the throat toward another end of the throat in a right-left width direction that is a direction parallel to the ball-hitting face, reaches a maximum, and then gradually decreases toward the other end, the front-back width is maximum at a position closer to the one end than to the other end in the right-left width direction, and the groove is formed on the one end side.

4. The racket frame according to claim 3, wherein a ratio (A/B) of a depth A of the groove from the one end in the right-left width direction and a distance B, in the right-left width direction, from the one end to the position at which the front-back width is maximum is less than 1.0.

5. The racket frame according to claim 2, wherein a depth A of the groove in a cross section of the center of the throat in the longitudinal direction is equal to or greater than 2 mm but equal to or less than 6 mm.

6. The racket frame according to claim 2, wherein the groove is formed so as to extend from the head side end of the throat to a shaft side end of the throat.

7. The racket frame according to claim 2, wherein the groove is formed so as to be connected to a gut groove formed in an outer peripheral surface of the head.

8. The racket frame according to claim 1, wherein a compressive rigidity of the throats in a front-back width direction that is a direction perpendicular to a ball-hitting face is equal to or less than 2600 kgf/mm.

* * * * *